US007195072B2

(12) United States Patent
MacKay et al.

(10) Patent No.: US 7,195,072 B2
(45) Date of Patent: Mar. 27, 2007

(54) INSTALLATION OF DOWNHOLE ELECTRICAL POWER CABLE AND SAFETY VALVE ASSEMBLY

(75) Inventors: Graham MacKay, Aberdeen (GB); Colin Rae, Aberdeen (GB); Steve McLeod, The Horner Kemnay (GB); Martin Riddell, Ellon (GB)

(73) Assignee: Weatherford/Lamb, Inc., Houston, TX (US)

( * ) Notice: Subject to any disclaimer, the term of this patent is extended or adjusted under 35 U.S.C. 154(b) by 158 days.

(21) Appl. No.: 10/685,296

(22) Filed: Oct. 14, 2003

(65) Prior Publication Data

US 2005/0077050 A1 Apr. 14, 2005

(51) Int. Cl.
*E21B 23/00* (2006.01)

(52) U.S. Cl. ..... 166/369; 166/105; 166/68; 166/66.6

(58) Field of Classification Search ..... 166/65.1, 166/68, 66.6, 105, 106, 370
See application file for complete search history.

(56) References Cited

U.S. PATENT DOCUMENTS

| | | | | |
|---|---|---|---|---|
| 3,844,345 | A | 10/1974 | Evans et al. | |
| 4,444,403 | A | 4/1984 | Morris | |
| 4,461,353 | A * | 7/1984 | Vinzant et al. | 166/322 |
| 4,478,288 | A | 10/1984 | Bowyer | |
| 4,569,392 | A | 2/1986 | Peterman | |
| 4,660,635 | A | 4/1987 | Wittrisch | |
| 4,749,341 | A | 6/1988 | Bayh, III | |
| 5,125,457 | A | 6/1992 | Meaders | |
| 5,823,265 | A * | 10/1998 | Crow et al. | 166/373 |
| 5,901,789 | A | 5/1999 | Donnelly et al. | |
| 6,173,788 | B1 | 1/2001 | Lembcke et al. | |
| 6,196,766 | B1 | 3/2001 | Graham | |
| 6,234,247 | B1 * | 5/2001 | Head | 166/65.1 |
| 6,250,384 | B1 * | 6/2001 | Beauquin | 166/105.5 |
| 6,341,652 | B1 * | 1/2002 | Malone et al. | 166/133 |
| 6,367,555 | B1 | 4/2002 | Senyard, Sr. et al. | |
| 6,446,723 | B1 | 9/2002 | Ramos et al. | |
| 6,457,518 | B1 | 10/2002 | Castano-Mears et al. | |
| 6,513,594 | B1 | 2/2003 | McCalvin et al. | |
| 6,550,535 | B1 | 4/2003 | Traylor | |

(Continued)

FOREIGN PATENT DOCUMENTS

| | | |
|---|---|---|
| EP | 0 651 130 | 5/1995 |

(Continued)

OTHER PUBLICATIONS

Introduction—RNG Lock Velocity String System, Weatherford Completion Systems, 2002, U.S.A.

(Continued)

*Primary Examiner*—William Neuder
*Assistant Examiner*—Nicole A Coy
(74) *Attorney, Agent, or Firm*—Patterson & Sheridan, L.L.P.

(57) ABSTRACT

The present invention generally provides apparatus and methods for removing liquid from a well. In one embodiment, a cable and subsurface safety valve assembly is used with a downhole pumping system to remove water from the well. The cable and subsurface safety valve assembly allows the cable to run from surface to a pumping unit while maintaining safety valve integrity. In another aspect, the cable and subsurface safety valve assembly may be adapted for use with an existing production tubing.

36 Claims, 10 Drawing Sheets

U.S. PATENT DOCUMENTS

| | | | |
|---|---|---|---|
| 6,595,280 | B2 | 7/2003 | Traylor |
| 2001/0047871 | A1 | 12/2001 | Johnson et al. |
| 2002/0040788 | A1 | 4/2002 | Hill, Jr. et al. |
| 2002/0053439 | A1 | 5/2002 | Danos |
| 2002/0088744 | A1 | 7/2002 | Echols |
| 2002/0092649 | A1 | 7/2002 | Bixenman et al. |
| 2002/0125009 | A1 | 9/2002 | Wetzel et al. |
| 2003/0056947 | A1 | 3/2003 | Cameron |
| 2003/0056948 | A1 | 3/2003 | Cameron |
| 2003/0079880 | A1 | 5/2003 | Deaton et al. |

FOREIGN PATENT DOCUMENTS

| | | |
|---|---|---|
| WO | WO 00/75933 | 12/2000 |
| WO | WO 01/29368 | 4/2001 |
| WO | WO 02/055841 | 7/2002 |

OTHER PUBLICATIONS

U.K. Search Report, Application No. GB0422688.2, dated Jan. 12, 2005.

* cited by examiner

INSTALLATION OF DOWNHOLE ELECTRICAL POWER CABLE AND SAFETY VALVE ASSEMBLY

BACKGROUND OF THE INVENTION

1. Field of the Invention

The present invention relates to apparatus and methods of producing hydrocarbon. Particularly, the present invention relates to apparatus and methods of stimulating the production of hydrocarbon by removing liquid from the wellbore. More particularly, the present invention relates to apparatus and methods of removing liquid from the wellbore by installing a pumping unit downhole in a well having a safety valve.

2. Description of the Related Art

In the oil and gas production industry, and more specifically in the production of natural gas, water encroachment into the wellbore presents significant difficulties in maintaining production output. Generally, water in the produced fluid is not problematic if water only makes up small portion of the produced fluid. In small quantities, the water will typically remain in droplet form, and the velocity of the produced gas flowing from the formation into the wellbore and up to surface will often be sufficient to entrain the water droplets and carry the droplets to surface.

However, as the proportion of water in the produced fluid increases, the hydrostatic pressure increases because the density of the gas/water droplet column in the wellbore rises. The increase in hydrostatic pressure decreases the pressure gradient between the gas-producing formation and the section of wellbore which intersects the formation. As a result, hydrocarbon flowing into the wellbore from the formation is limited.

Furthermore, the level of water in the produced fluid adversely affects the velocity of the gas moving to the surface. The velocity of the gas may be reduced to a level insufficient to carry the water droplets out of the well, thereby increasing the rate of hydrostatic pressure buildup. In some cases, the increase in hydrostatic pressure may kill the well.

All of these problems are particularly acute in depleted wells; that is, wells that have been producing for some time and that the formation pressure has diminished to a level of economic or physical unfeasibility.

One temporary solution used in the industry is installing velocity strings in the wellbore. Velocity strings are designed to restrict the cross-sectional flow area up the wellbore, thereby increasing the velocity of the produced gas as it travels up the wellbore. However, velocity strings create significant flow restrictions in the wellbore, which leads to lower production rates. In addition, the restricted strings may also cause the velocity of the gas to drop below the rate necessary to carry the water droplets to surface. Eventually, the well is again killed.

Artificial lift systems are commonly employed to assist in the recovery of hydrocarbons. A simple form of an artificial lift system may include a pumping unit disposed downhole. The deployment of the pumping unit, such as an electrical submersible pump, usually requires a cable extending back to the surface. Once downhole, the pumping unit may be operated to pump the water to surface, thereby reviving the well.

However, the deployment of the pumping unit in an offshore well presents various challenges. Offshore wells are often equipped with a surface controlled subsurface safety valve ("scssv"). In many instances, the safety valve is a legal requirement. Safety valves are generally used as a safety device to ensure that if the fluid conduit between the ocean floor and the platform is disrupted, the flow of production fluid from the sub-sea well head will be cut off and the ocean will not be contaminated with production fluid. One obstacle to installing a pumping unit downhole is the inability to run the cable or other connection means through the safety valve while keeping the safety valve operational. Particularly, the safety valve can not close and seal properly with the cable extending therethrough.

To overcome this problem, it is known to remove the entire production string and replace it with a modified production string. In this arrangement, the cable is disposed in the annulus defined by the modified string and the casing. However, this solution typically involves expensive workover equipment which may be uneconomical for a marginal well.

There is a need, therefore, for an apparatus and method of operating a pumping unit disposed below a safety valve. There is also a need for an apparatus and method for installing a downhole cable and a safety valve assembly. Further, there is a need for an apparatus and method to install an artificial lift system to revive a well.

SUMMARY OF THE INVENTION

The present invention generally provides apparatus and methods for removing liquid from a well. In one embodiment, the apparatus includes a subsurface safety valve for regulating fluid flow through the tubular and a connection member for supplying energy to the downhole pumping system. The apparatus allows the connection member to run from surface to the pumping system while maintaining safety valve integrity.

In another embodiment, the apparatus may further include a locking mandrel for engaging the tubular and a tubing insert for transporting fluid to surface. The apparatus may also include at least one electrical adapter for routing the connection member between the exterior and the interior of the safety valve.

In another aspect, the present invention may be used with an existing production tubing. Particularly, a cable and subsurface safety valve assembly may be installed in the production tubing. The safety valve assembly may further include a pumping system, all of which may be installed in one trip.

In operation, liquid may be pumped up a liquid conduit and mixed with gas flowing in the production tubing as the liquid exits the liquid conduit. Preferably, the gas contains sufficient energy to carry the fluid mixture through the safety valve and up to surface.

In another aspect, a method of removing liquid from a well having a production tubing includes installing a safety valve in the production tubing and locating a pumping system in the well. A connection member is provided to supply energy to operate the pumping system. In one embodiment, the connection member extends through the production tubing. Preferably, the safety valve and the pumping system are located in the well in one trip.

In another aspect, a method of removing liquid from a well having a production tubing comprises installing a cable from surface to a pumping system through the production tubing, wherein the pumping system is disposed below a subsurface safety valve.

In another aspect still, a method of actuating a pumping system disposed downhole comprises supplying power from surface to the pumping system through a safety valve.

In another aspect still, a method of actuating a downhole tool, comprises supplying power to the downhole tool through a safety valve.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 4A is a cross-section view of the safety valve assembly taken at line I—I in FIG. 1. FIG. 4B is a cross-section view of the safety valve assembly taken at line II—II in FIG. 1. FIG. 40 is a cross-section view of the safety valve assembly taken at line III—III in FIG. 1. FIG. 4D is a cross-section view of the safety valve assembly taken at line IV—IV in FIG. 1. FIG. 4E is a cross-section view of the safety valve assembly taken at line V—V in FIG. 1.

DETAILED DESCRIPTION OF THE PREFERRED EMBODIMENT

Aspects of the present invention relates to a downhole cable and safety valve assembly 100 used to facilitate the production of hydrocarbon. The cable and safety valve assembly 100 may be used in a subsea well to operate a pumping unit to remove liquid in the production zone. The present invention may also be used to install other connections means, such as a rod, to operate other types of artificial lift systems downhole.

Figure 6A:
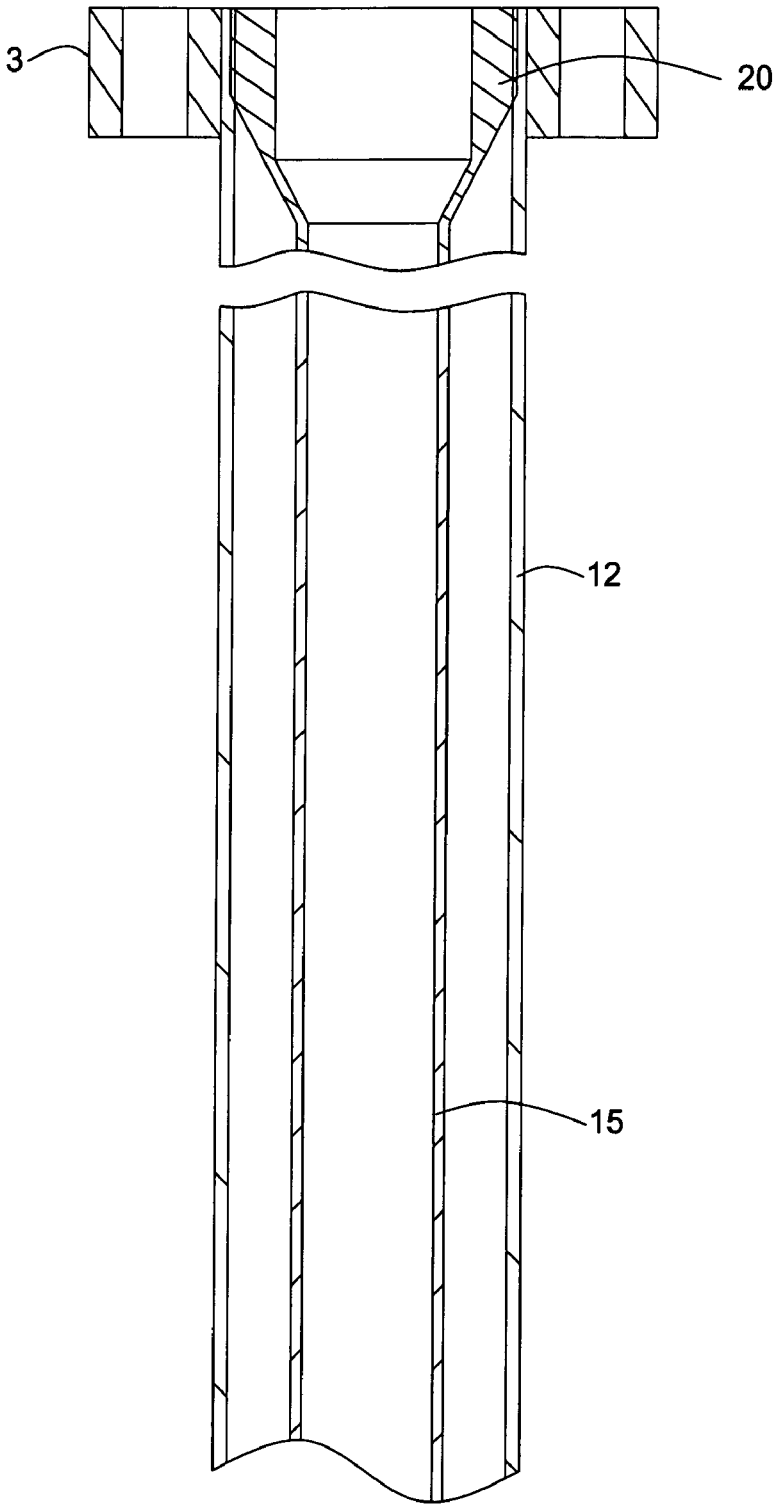
FIGS. 6A–C depict a production tubing with the safety valve removed, thereby providing a nipple for receive a cable and safety valve assembly according to aspects of the present invention.
Figure 6B:
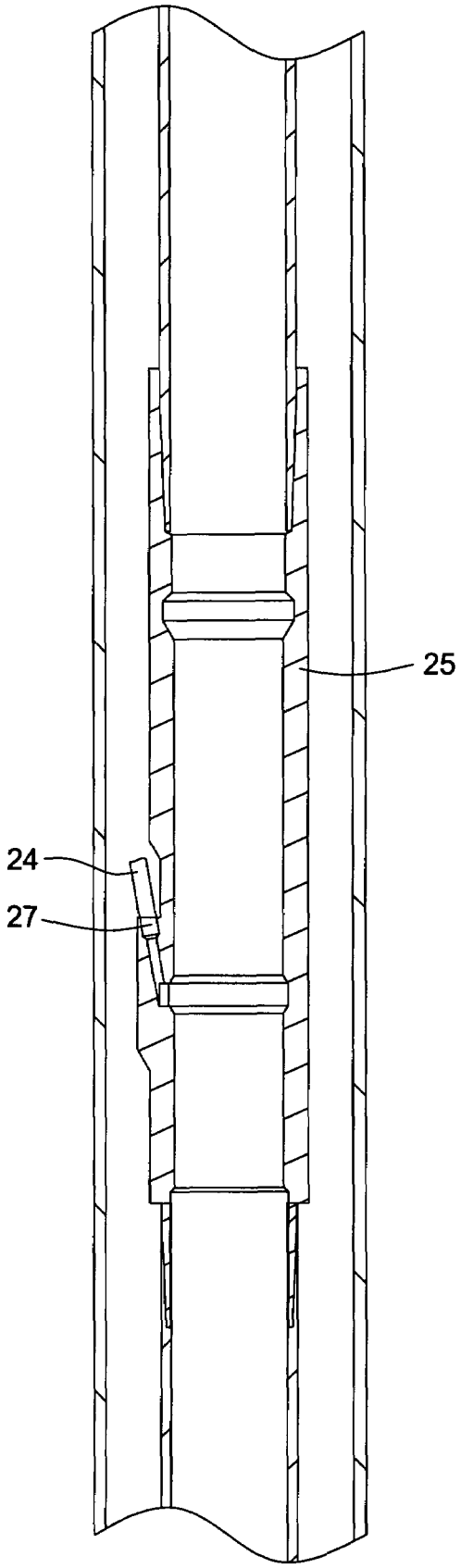
Figure 6C:
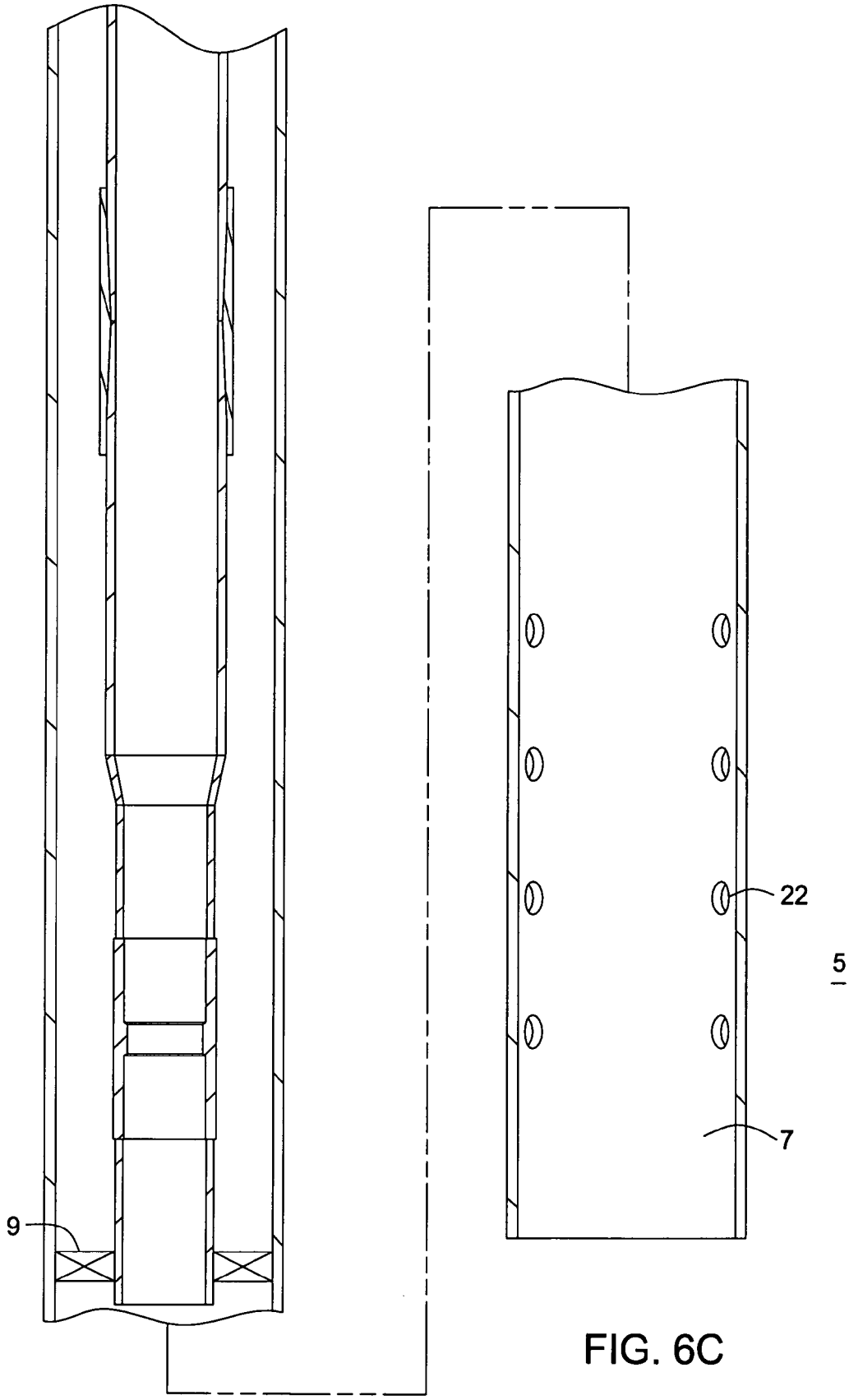

FIGS. 6A–C depict a well 3 that has encountered excessive water production. As shown, a casing 12 has been installed in the wellbore 7, and a production tubing 15 is hung off of the casing 12 using a production tubing hanger 20. Perforations 22 are made in the casing 12 adjacent the production zone 5 to allow hydrocarbon to flow into the wellbore 7. A packer 9 is provided at a lower portion of the production tubing 15 to seal off the annular area between the casing 12 and the production tubing 15. The production tubing 15 includes a surface controlled subsurface safety valve ("scssv") nipple 25 and a valve control port 27. As shown, the previous safety valve has been removed, thereby allowing access to the nipple 25.

In one aspect, the cable and safety valve assembly 100 of the present invention may be installed in the existing production tubing 15, thereby replacing the previous safety valve. In this respect, the cable and safety valve assembly 100 may utilize the scssv nipple 25 of the existing production tubing 15. Furthermore, hydraulic fluid may be supplied through the valve control port 27 of the existing scssv nipple 25 to operate the cable and safety valve assembly 100. Optionally, one or more sealing elements 28 may be provided to isolate the valve control port 27.

Figure 1A:
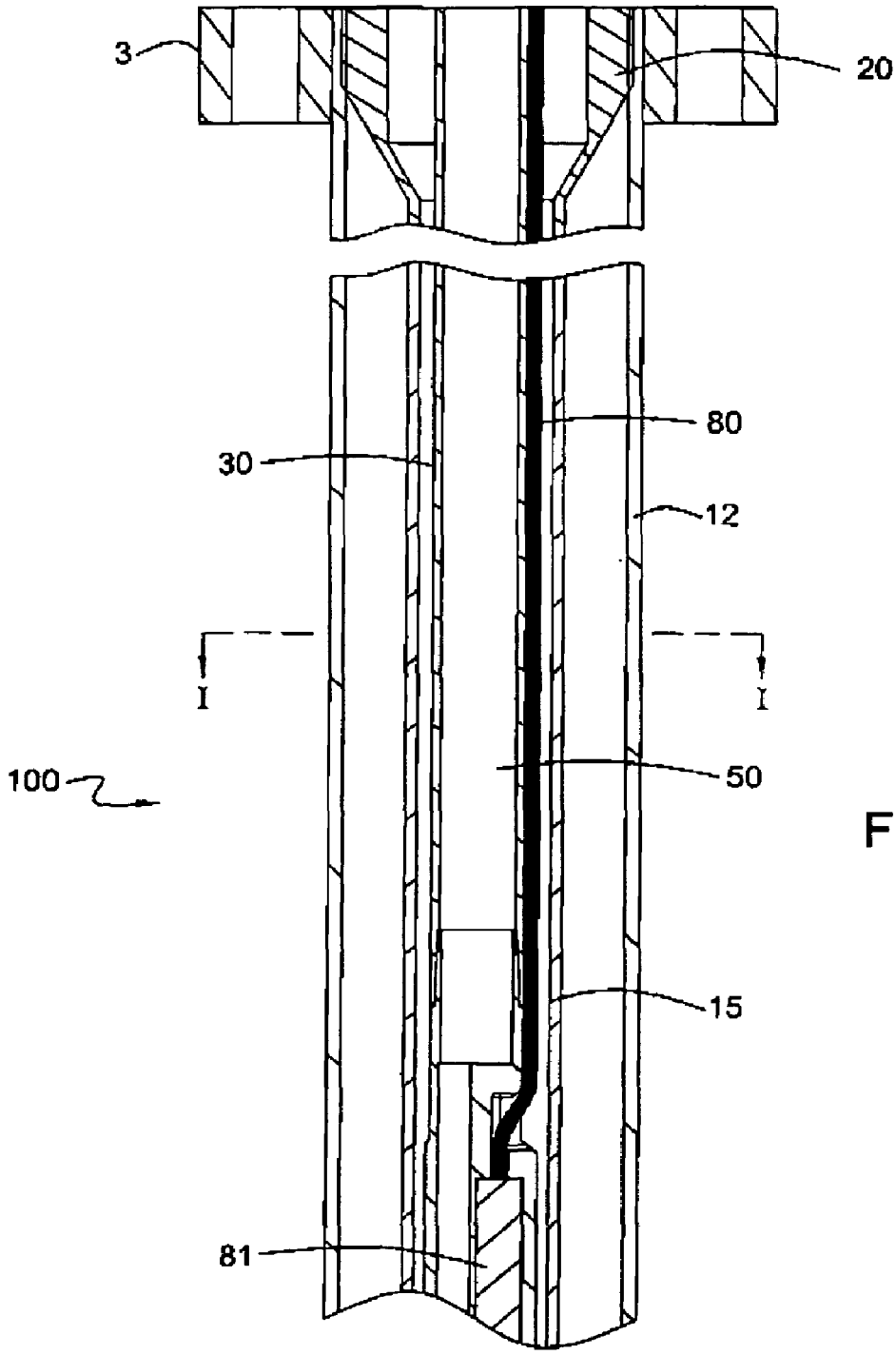
FIG. 1 is a cross-sectional view of a cable and safety valve assembly disposed in an existing production tubing according to aspects of the present invention.
Figure 1B:
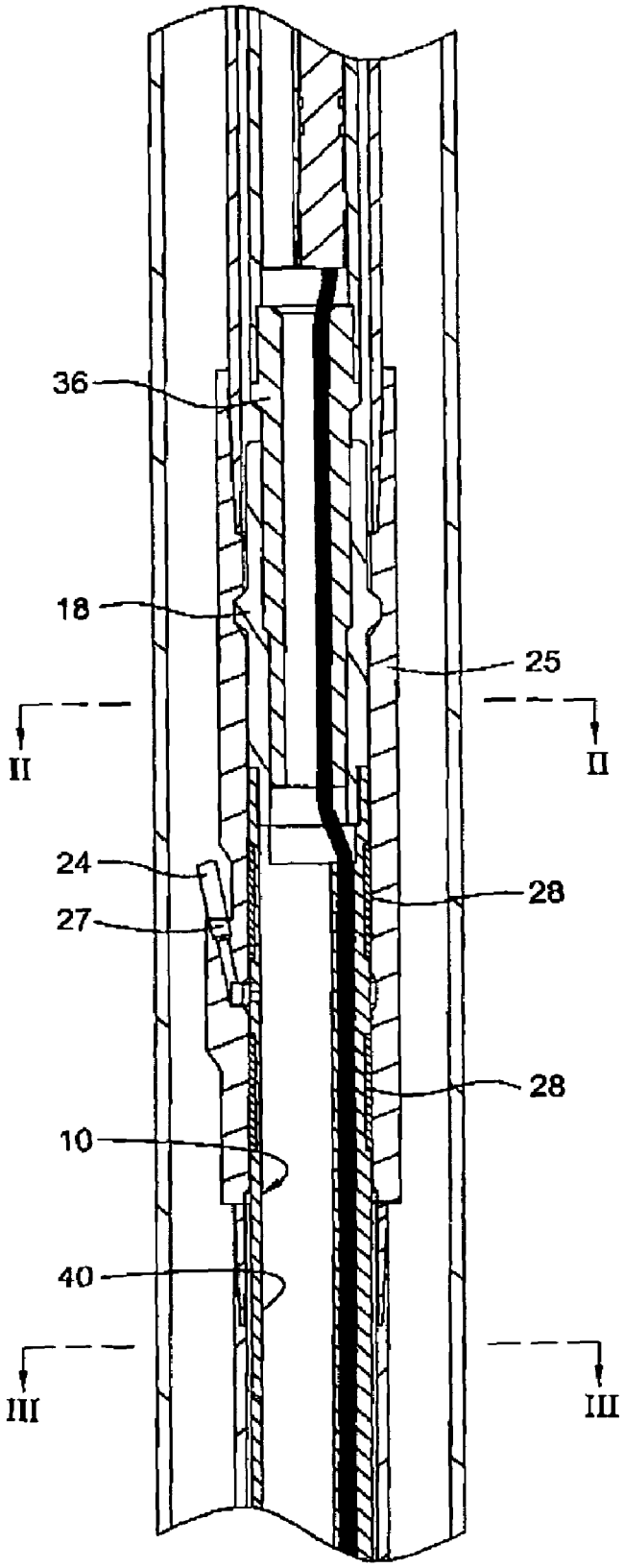
Figure 1C:
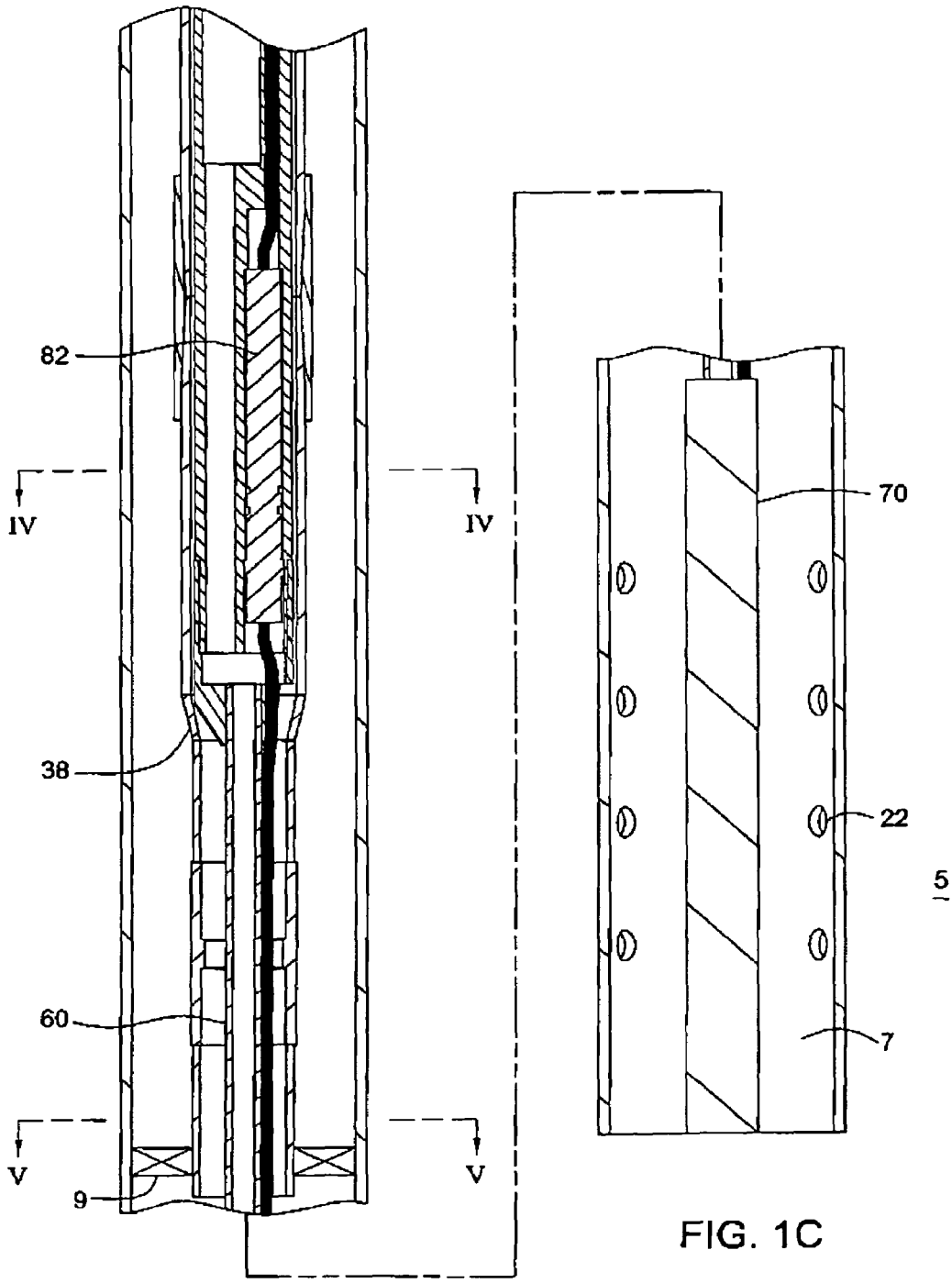

FIG. 1 is a cross-sectional view of the preferred embodiment of the cable and safety valve assembly 100 disposed in the production tubing 15. The assembly 100 includes a tubing string insert 30 extending from the surface to a tubing lock mandrel 36. The tubing lock mandrel 36 includes connection means 18 such as dogs for mating with the scssv nipple 25. Disposed below the tubing lock mandrel 36 is a safety valve 10, which is represented in FIG. 1 only by its sealing mandrel 40. A lower sub 38 and the tubing lock mandrel 36 are used to sealingly connect the safety valve 10 to the production tubing 15. The assembly 100 also includes a water conduit 60 that extends from the lower sub 38 to a pump and motor system 70. In this respect, the lower sub 38 acts as an interface between the safety valve 10 and the water conduit 60. The pump and motor system 70 is located in the production zone 5 to facilitate the removal of water.

Figure 2:
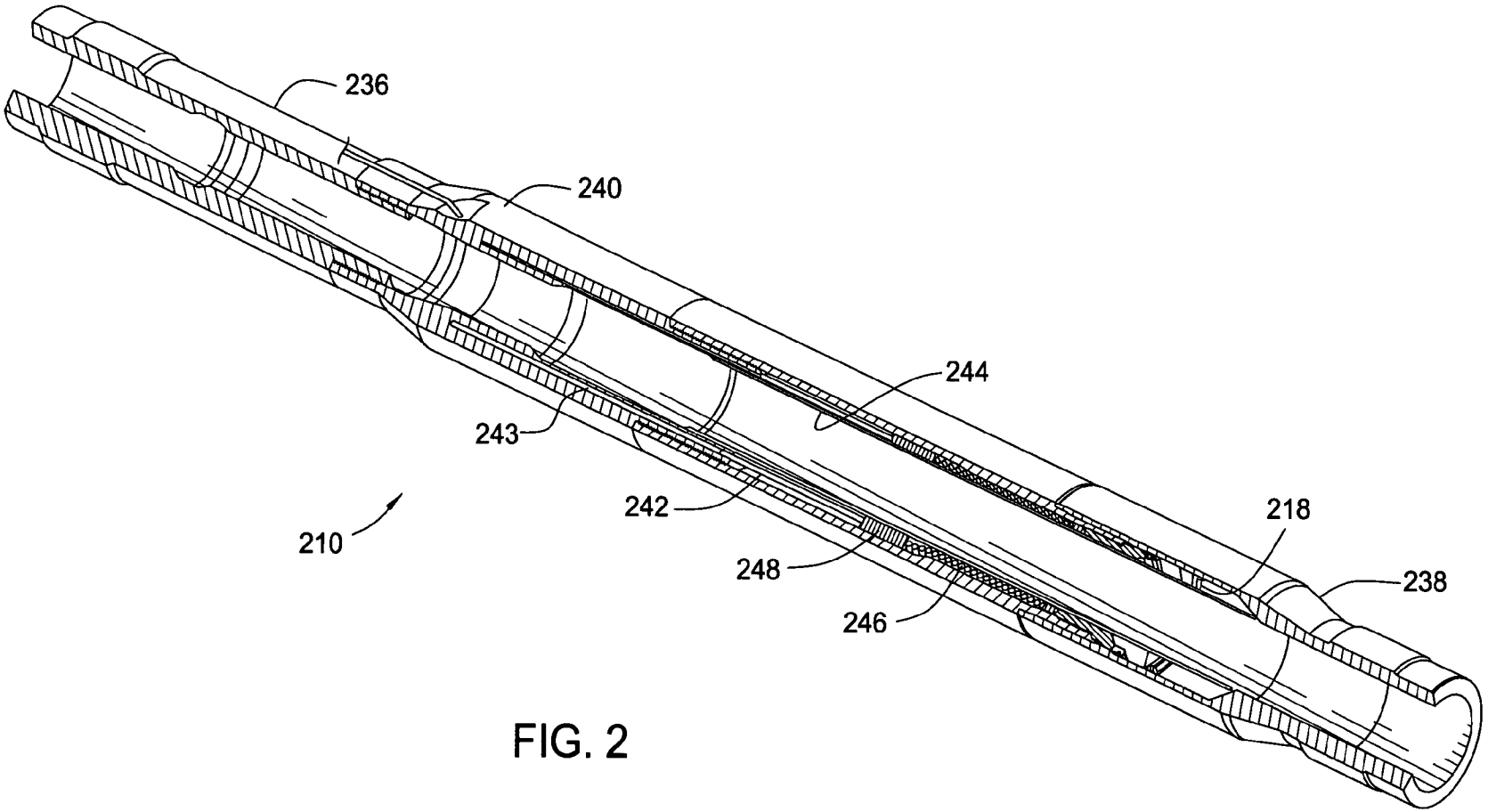
FIG. 2 depicts an exemplary safety valve in the open position.

According to aspects of the present invention, the safety valve 10 may be selected from a variety of safety valves known to a person of ordinary skill in the art. Examples of safety valves contemplated include flapper, ball, annulus type valves, and other safety valves known to a person of ordinary skill in the art. FIG. 2 depicts an exemplary safety valve 210 usable with the present invention. In FIG. 2, a flapper type safety valve 210 is shown in the open position. The subsurface safety valve 210 is shown with a tubing lock mandrel 236 and a lower sub 238 to sealingly connect the safety valve 210 to the production tubing 15. The safety valve 210 is maintained in the open position by hydraulic pressure. Hydraulic pressure is supplied by a pump (not shown) through a control line 24 and the control port 27 to the safety valve 210. The hydraulic pressure holds the flapper 218 within the safety valve 210 in the open position. Because the safety valve 210 is a "fail closed" device, loss of hydraulic pressure in the control line will cause the flapper 218 to close, thereby blocking the upward flow of gas to the surface.

As noted, the safety valve 210 shown in FIG. 2 is hydraulically actuated. In this respect, the safety valve 210 includes a sealing mandrel 240 having a hydraulic chamber 243 and a piston 242 therein. The piston 242 is a pressure actuated tubular piston which moves within the housing 240. Alternatively, the piston may be a small diameter piston or other less common actuators such as electric solenoid actuators, motorized gear drives and gas charged valves.

Energizing the piston 242 serves to open the subsurface safety valve 210 for fluid flow. In the arrangement shown in FIG. 2, the application of hydraulic pressure through the control port 27 serves to force the piston 242 within the sealing mandrel 240 downward. The piston 242, in turns, acts upon a flow tube 244, translating the flow tube 244 longitudinally. Additionally, the energy from the piston 242, through a compression member 248, compresses a spring 246 that is used to return the flapper 218 to the closed position. In FIG. 2, the flow tube 244 is shown shifted fully downward due to the energy from the piston 242. In this position, the flow tube 244 maintains the flapper 218 (obscured by flow tube 244 in this figure) in an open position.

Figure 3:
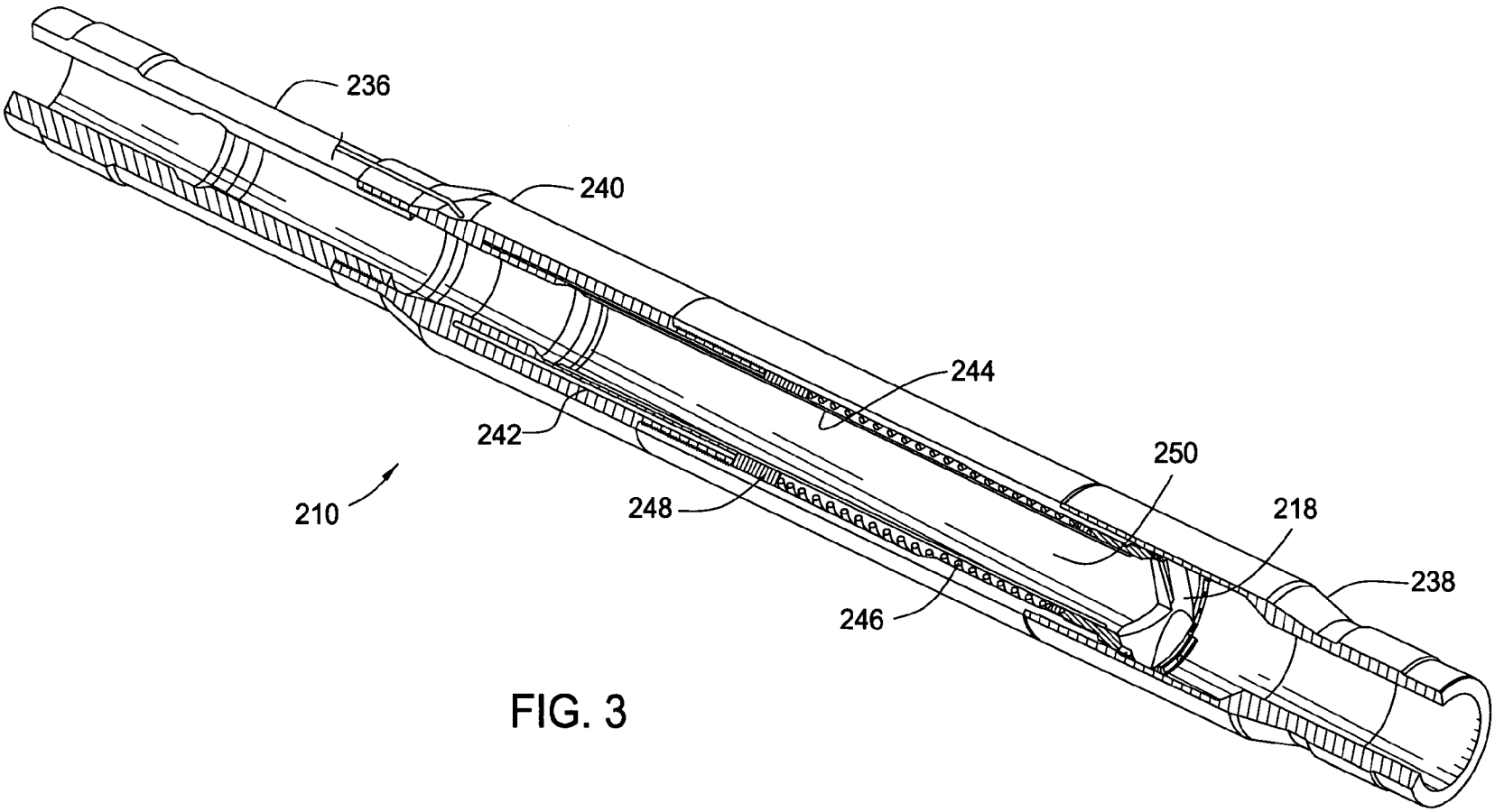
FIG. 3 depicts the exemplary safety valve in the closed position.

FIG. 3 presents the safety valve 210 in its closed position. When pressure (or energy) is relieved from the piston 242, the spring 246 releases to act on the compression member 248, thereby moving the flow tube 244 longitudinally upward. This, in turn, frees the flapper 218 from the flow tube 244 and allows the flapper 218 return to its normally closed position. In the closed position, the flapper 218 blocks the axial bore 250 extending through the safety valve 210 from fluid communication. Other exemplary safety valves contemplated by the present invention are disclosed in U.S. Pat. Nos. 5,125,457 and 6,513,594 and U.S. Publication Nos. 2002/0040788 and 2003/0079880, all of which are incorporated by reference herein in their entirety.

Figure 4A:
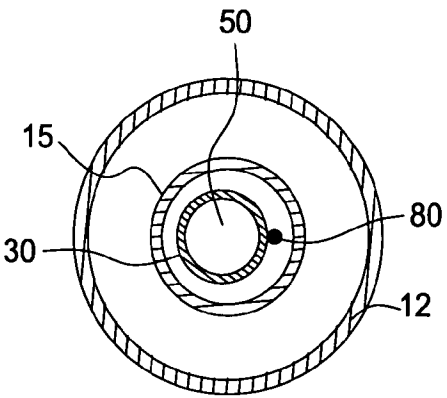
FIG. 4A–E depicts cross-sectional view of various locations of the cable and safety valve assembly shown in FIG. 1.
Figure 4B:
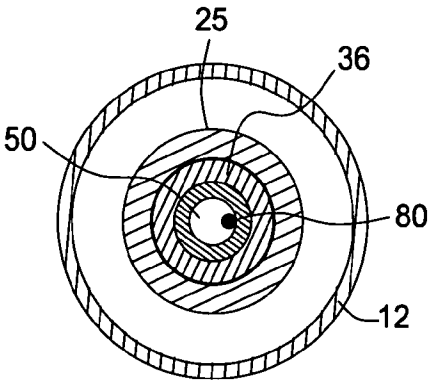

Aspects of the present invention provide a novel way of running the cable 80 from surface while maintaining subsurface safety valve 10 integrity. In the one embodiment, the cable 80 is integrated with the safety valve 10. In a preferred embodiment shown in FIG. 1, the cable 80 is initially disposed exterior to the tubing string insert 30. This can be clearly seen in FIG. 4A, which is a cross-sectional view take at line I—I of FIG. 1. As the cable 80 reaches the safety valve 10, the cable 80 is routed to the interior of the safety valve assembly 100 through a first electrical adapter 81. The first electrical adapter 81 is disposed proximate the fluid bore 50 of the safety valve assembly 100, which has been offset to accommodate the first electrical adapter 81. After leaving the first adapter 81, the cable 80 is directed through the tubing lock mandrel 36. As shown in FIG. 4B, the cable 80 is located inside the fluid bore 50 while it extends through the tubing lock mandrel 36.

Figure 4C:
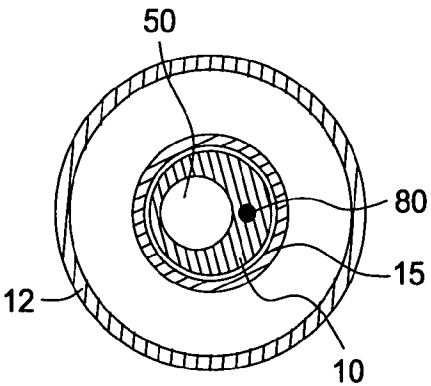

From the tubing lock mandrel 36, the cable 80 passes through the safety valve 10. In the preferred embodiment, the bore 50 inside the sealing mandrel 40 is offset relative to the central axis of the safety valve 10. In this respect, the cable 80 passes through the wall of the sealing mandrel 40 and adjacent to the bore 50. This arrangement is more clearly shown in FIG. 4C. Because the cable 80 is not located in the bore 50 of the safety valve 10, operation of the safety valve 10, particularly, the opening and closing of the flapper 218, is not impeded.

Figure 4D:
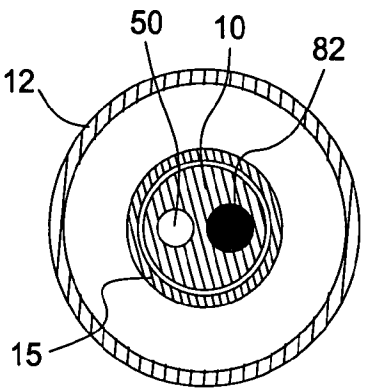
Figure 4E:
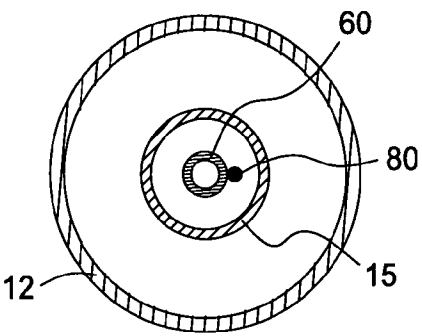

Thereafter, the cable 80 is re-routed to the exterior of the safety valve assembly 100 through a second electrical adapter 82. FIG. 4D shows a cross-section view of the assembly 100 taken at line IV—IV of FIG. 1. From there, the cable 80 extends along the exterior of the water conduit 60 to the pump and motor system 70 as shown in FIG. 1 and FIG. 4E.

In operation, cable and safety valve assembly 100 may be used with the existing production tubing 15 of a pre-selected well. Prior to insertion of the cable and safety valve assembly 100, the existing scssv (not shown) is removed from the existing scssv nipple 25, as illustrated in FIGS. 6A–C. Thereafter, the cable and safety valve assembly 100 having the pump and motor system 70, the water conduit 60, the safety valve 10, the tubing string insert 30, and the cable 80 is run into the wellbore 7 in one trip. Because the location of the existing scssv nipple 25 is known, the distance between the pump and motor system 70 and the safety valve 10 can be determined such that after the tubing lock mandrel 36 mates with the scssv nipple 25, the pump and motor system 70 is positioned properly in the wellbore 7 to remove water from the production zone.

Figure 5:
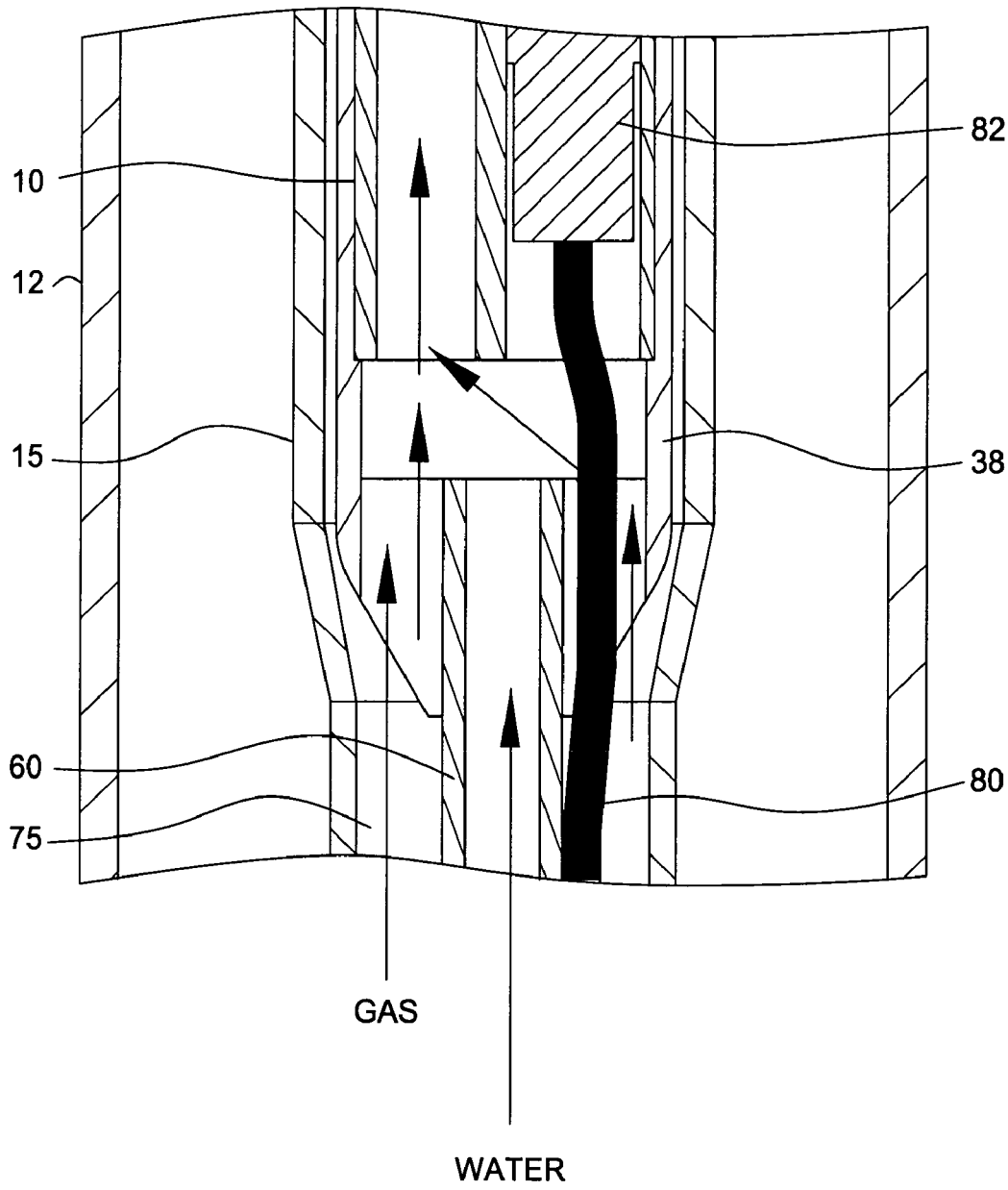
FIG. 5 is an exploded view of a portion of the lower sub.

Power supplied through the cable 80 actuates the pump 70 to pump water up the water conduit 60. At the same time, gas in the production zone 5 may flow up the annulus 75 defined by the water conduit 60 and the production tubing 15. In one embodiment, water in the water conduit 60 is expelled into the lower sub 38 when it exits the end of the water conduit 60, as shown in FIG. 5. Preferably, the water leaving the water conduit 60 is in droplet form. As noted above, the lower sub 38 is the interface between the water conduit 60 and the safety valve 10. Therefore, gas flowing up the annulus 75 also enters the lower sub 38. In this respect, the water droplet is allowed to mix or co-mingle with the gas in the lower sub 38. As shown in FIG. 5, water in the water conduit 60 exits into the lower sub 38, where it is carried by the gas into the safety valve 10. It is believed that the gas flowing through the lower sub 38 contains sufficient energy to carry the water upwardly through the safety valve 10 and onto the surface, where they may be separated. In this manner, water may be removed from the well to resuscitate or maintain the hydrocarbon production.

According to aspects of the present invention, the pumping system 70 may be selected from a variety of pumping systems known to a person of ordinary skill in the art. Furthermore, the cable and safety valve assembly 100 may be adapted to run non-cable type connection means, such as a rod, electric wire, or tubing, to operate the selected pumping system. Suitable pumping systems may include an electrical submersible pump. In one embodiment, the pumping system selected is capable of operating at high pressure with low volume. In another aspect, the pumping system may be operated from the surface. In this respect, a control system may be installed at the surface and adapted to provide power to the pump. The pump may be operated to maintain an optimal gas flow rate at the surface.

It must be noted that the cable and safety valve assembly of the present invention may be utilized to run a cable from surface to a subsea pumping system or any other subsea electrical equipment while maintaining safety valve integrity. Moreover, the cable and safety valve assembly may be utilized generally to run a cable downhole to operate a downhole tool, such as sensors, pumps, controls, and any other types of powered downhole tools. It is intended that the cable and safety valve system may be installed without the use of expensive workover equipment.

While the foregoing is directed to embodiments of the present invention, other and further embodiments of the invention may be devised without departing from the basic scope thereof, and the scope thereof is determined by the claims that follow.

We claim:

1. An apparatus for use with a downhole pumping system to facilitate fluid flow in a tubular, comprising:

a subsurface valve for regulating fluid flow through the tubular, the subsurface valve having a bore in fluid communication with the tubular; and a connection member for supplying energy to the downhole pumping system disposed below the subsurface valve, wherein a portion of the connection member traverses the bore of the subsurface valve and the connection member is capable of supplying energy to the downhole pumping system when the subsurface valve is closed.

2. The apparatus of claim 1, further comprising a locking mandrel for engaging the tubular.

3. The apparatus of claim 1, further comprising a tubing insert for transporting fluid to surface.

4. The apparatus of claim 3, wherein a portion of the connection member is disposed in an annulus defined by the tubing insert and the tubular.

5. The apparatus of claim 1, further comprising at least one electrical adapter for routing the connection member between an exterior and an interior of the valve.

6. The apparatus of claim 1, wherein the valve mates with an existing valve nipple of the tubular.

7. The apparatus of claim 1, wherein a portion of the bore is offset relative to a central axis of the valve.

8. The apparatus of claim 1, further comprising a liquid conduit extending from the valve to the pumping system.

9. The apparatus of claim 8, wherein an annulus is defined by the liquid conduit and the tubular.

10. The apparatus of claim 9, wherein a second portion of the connection member is disposed in the annulus.

11. The apparatus of claim 9, wherein gas flows up the annulus and the liquid flows up the liquid conduit.

12. The apparatus of claim 11, wherein the liquid and the gas are mixed before entering the safety valve.

13. The apparatus of claim 1, wherein the tubular comprises a production tubing.

14. The apparatus of claim 1, wherein the connection member is selected from the group consisting of cable, electric wire, tubing, and rod.

15. A method of removing liquid from a well having a production tubing, comprising:

installing a valve in the production tubing, wherein the valve is adapted to open or close fluid communication through the production tubing;

locating a pumping system below the valve;

providing a connection member in the production tubing to supply energy to operate the pumping system, the connection member traversing an interior portion of the valve and is adapted to supply energy to the pumping system when the valve is closed; and supplying energy to the pumping system to remove liquid from the well.

16. The method of claim 15, further comprising transporting liquid to the valve through a liquid conduit.

17. The method of claim 16, further comprising mixing the liquid with gas before entering the valve.

18. The method of claim 15, wherein installing the valve and locating the pumping system is performed in one trip.

19. The method of claim 15, further comprising removing a pre-existing valve before installing the valve.

20. The method of claim 15, wherein at least a portion of the connection member is disposed in the valve.

21. The method of claim 15, further comprising routing the connection member from the exterior of the valve to the interior of the valve.

22. The method of claim 15, further comprising integrating the connection member with the valve.

23. The method of claim 15, wherein the connection member comprises a cable.

24. A method of actuating a downhole tool disposed in a tubular, comprising:

locating a valve in the tubular upstream from the downhole tool, the valve having:

a first end and a second end; and a closure member adapted to block fluid communication in the tubular;

traversing a connection member in the interior of the valve from the first end to the second end; and supplying energy downstream to the downhole tool after closing the valve.

25. The method of claim 24, further comprising integrating the connection member with the valve.

26. The method of claim 24, further comprising closing the closure member in response to a pressure surge.

27. The method of claim 24, wherein the valve and the downhole tool is lowered into the tubular in a single trip.

28. The method of claim 24, wherein the downhole tool comprises a pump.

29. The method of claim 24, wherein the valve is connected to pre-existing valve nipple of the tubular.

30. The method of claim 24, further comprising providing a fluid conduit extending from the valve to the downhole tool.

31. The method of claim 30, wherein an annulus is defined by the fluid conduit and the tubular.

32. The method of claim 31, further comprising flowing gas up the annulus and flowing liquid up the fluid conduit.

33. The method of claim 32, further comprising mixing the gas and the liquid before entering the safety valve.

34. The method of claim 24, wherein the connection member comprises cable.

35. The method of claim 24, wherein the tubular comprises production tubing.

36. The method of claim 24, wherein locating the valve in the tubular comprises coupling the valve to the tubular.

* * * * *